US005152194A

United States Patent [19]

Keshavan et al.

[11] Patent Number: 5,152,194

[45] Date of Patent: Oct. 6, 1992

[54] HARDFACED MILL TOOTH ROTARY CONE ROCK BIT

[75] Inventors: Madapusi K. Keshavan; Scott D. McDonough, both of The Woodlands; Robert H. Slaughter, Jr., Houston, all of Tex.

[73] Assignee: Smith International, Inc., Houston, Tex.

[21] Appl. No.: 690,454

[22] Filed: Apr. 24, 1991

[51] Int. Cl.[5] ..... B21K 5/02

[52] U.S. Cl. ..... 76/108.2

[58] Field of Search ..... 76/108.1, 108.2, 108.4, 76/DIG. 11; 51/309, 307, 293, DIG. 26

[56] References Cited

U.S. PATENT DOCUMENTS

| | | | |
|---|---|---|---|
| 2,660,405 | 11/1953 | Scott et al. | 76/108.1 |
| 3,003,370 | 10/1961 | Coulter, Jr. | 76/108.1 |
| 4,726,432 | 2/1988 | Scott et al. | 76/108.2 |
| 4,836,307 | 6/1989 | Keshavan et al. . | |

*Primary Examiner*—Roscoe V. Parker

*Attorney, Agent, or Firm*—Robert G. Upton

[57] ABSTRACT

A milled teeth rotary cone rock bit consists of chisel crested milled teeth with generously radiused corners at the ends of the crest. A concave depression is formed in the crest between the radiused ends. A layer of hardfacing material formed over each tooth is thicker at the corners and in the concave depressions in the crest to provide a means to inhibit wear of the hardfacing as the bit works in a borehole.

15 Claims, 4 Drawing Sheets

HARDFACED MILL TOOTH ROTARY CONE ROCK BIT

BACKGROUND OF THE INVENTION

1. FIELD OF THE INVENTION

This invention relates to mill tooth rotary cone rock bits.

More particularly, this invention relates to milled tooth rotary cone rock bits with hardfacing material metallurgically bonded to the cutting edges of the teeth.

2. DESCRIPTION OF THE PRIOR ART

It is known to hardface steel teeth milled into rotary cones to enhance the cutting action of the teeth and to inhibit erosion and fracture of the teeth as the milled toothed bit works in an earthen rock formation.

U.S. Pat. No. 4,836,307 entitled Hard Facing For Milled Tooth Rock Bits assigned to the same assignee as the present invention describes a hardfacing to reduce erosion and abrasion associated with drilling in earthen formations.

The hardfacing for teeth on a milled tooth rock bit comprises at least 65% by weight of a mixture of tungsten carbide particles and a balance of steel bonding the carbide particles together and to the cutter cone of the rock bit. The tungsten carbide particle mixture comprises from 35% to 80%, and preferably from 65% to 80%, by weight 20 to 30 mesh cemented tungsten carbide, and from 20% to 65%, and preferably from 20% to 35% by weight 40 to 89 mesh single crystal monotungsten carbide.

Experience has shown however that, where hardfacing is applied around sharp corners retention of the hardfacing at the corners is difficult. For example, a milled tooth formed in a chisel shape is hardfaced over the apex from the side or flank of a tooth, across the crest of the tooth and down the opposite flank, the thickness of the material is less around the sharp corners. The hardfacing being thin in the corners tends to wear rapidly and flake off exposing the relatively softer steel forming the base of the tooth.

The present invention provides a means to retain the hardfacing material on the milled teeth especially around the vulnerable corners of the tooth adjacent the chisel type crest of the tooth.

In addition, the edges formed at the flank and end faces of each milled tooth is rounded to enhance retention of the hardmetal to the tooth.

Moreover, the present invention also provides a means to enhance the durability of the chisel crest of the milled tooth between the opposite radiused corners of the tooth.

SUMMARY OF THE INVENTION

It is an object of this invention to prevent premature wear and flaking off of hardfacing material from the surface of a milled steel tooth of a milled tooth rock bit during operation of the bit in a borehole.

It is another object of this invention to improve the durability of a crest of a chisel type milled tooth.

A method of hardfacing a cutter cone of milled tooth rotary cone rock bit is disclosed.

A crest of at least one chisel shaped mill tooth is shaped in a concave pattern from one corner to an opposite corner.

Each of the corners of the chisel crest of each tooth is provided with a generous radius such that the hardfacing material is layered over the radiused surface retaining a thickness sufficient to retard wear during operation of the bit in a borehole.

In addition, each edge along each side of the milled teeth is radiused to enhance adherence of the hardfacing material to each tooth.

Hardfacing material is applied over at least one chisel shaped mill tooth, the hardfacing material is uniformly applied over the generously radiused corners and is thicker in the concave crest area between the radiused corners to prevent hardfacing failure at the corners, edges and along the concave crest during operation of the milled tooth rotary cone bit in a borehole.

A shoulder is formed at the base of each tooth to form a uniform barrier for the termination of the hardfacing material covering each chisel type milled tooth.

An advantage then of the present invention over the prior art is the larger radius at the corners of a crest of a milled tooth to enable a thicker layer of hardfacing at the corners of the crest of the tooth.

Another advantage of the present invention over the prior art is the means in which a thicker layer of hardfacing is provided along a crest of a chisel type milled tooth between radiused corners to enhance the durability of the tooth as it operates in a borehole.

Yet another advantage of the present invention over the prior art is the radiusing of the corners adjacent the flanks and ends of the chisel crested teeth to further strengthen the capability of the tooth to retain its hardfacing during downhole operations.

DESCRIPTION OF THE PREFERRED EMBODIMENTS AND BEST MODE FOR CARRYING OUT THE INVENTION

Figure 1:
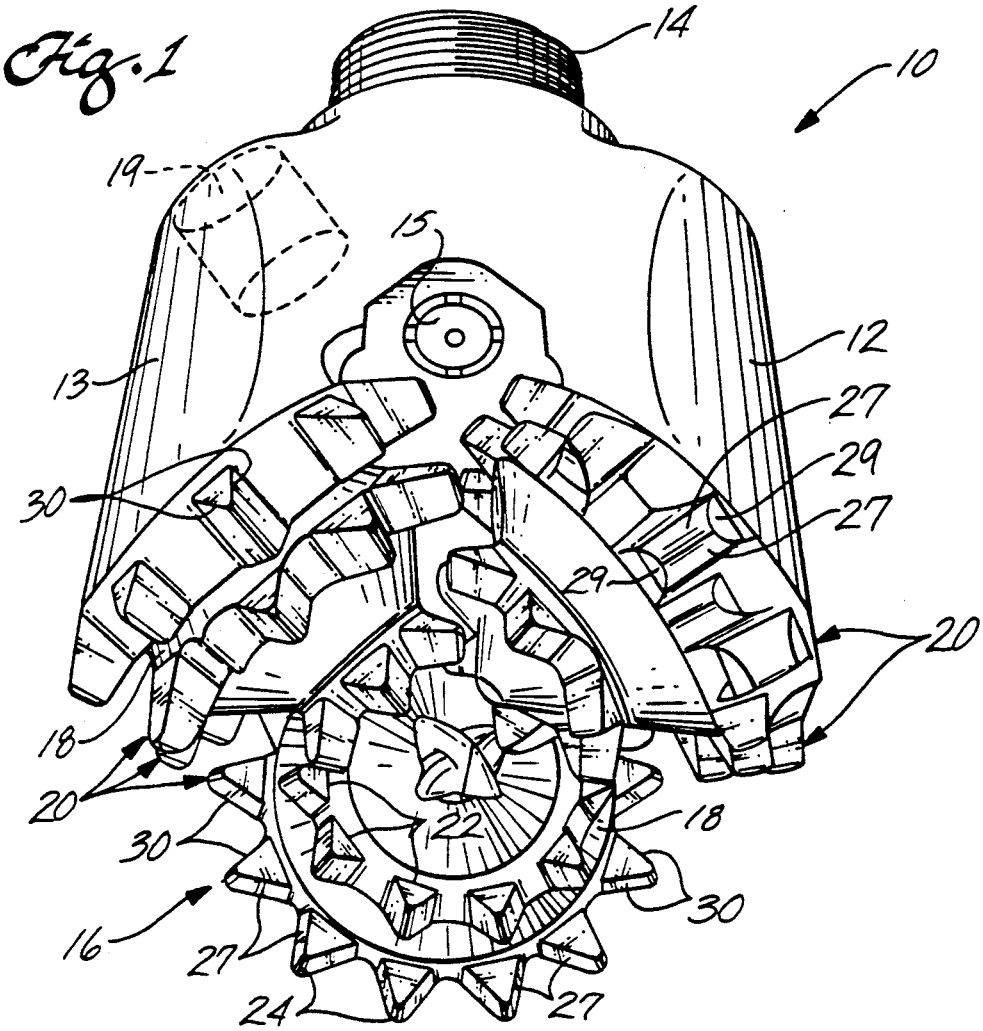
FIG. 1 is a perspective view of a milled tooth rotary cone rock bit with hardfacing material on each tooth.

FIG. 1 illustrates a mill tooth rotary cone rock bit generally designated as 10. The bit 10 consists of bit body 12 threaded at pin end 14 and cutting end generally designated as 16. Each leg 13 supports a rotary cone 18 rotatively retained on a journal catalevered from each of the legs (not shown). The mill teeth generally designated as 20 extending from each of the cones 18 is typically milled from steel.

Each of the chisel crested teeth 20 forms a crest 24, a base 22, two flanks 27, and tooth ends 29.

As indicated before hardfacing material is generally applied on each of the teeth 20. In some cases the application of hardfacing is applied only to the cutting side of the tooth as opposed to the other flanks and ends of the teeth.

The rock bit 10 further includes a fluid passage through pin 14 that communicates with a plenum chamber 17 (not shown). Typically one or more nozzles 15 are secured within body 12. The nozzles direct fluid from plenum chamber 17 towards a borehole bottom. The upper portion of each of the legs may have a lubricant reservoir 19 to supply a lubricant to each of the rotary cones 18.

Figure 2:
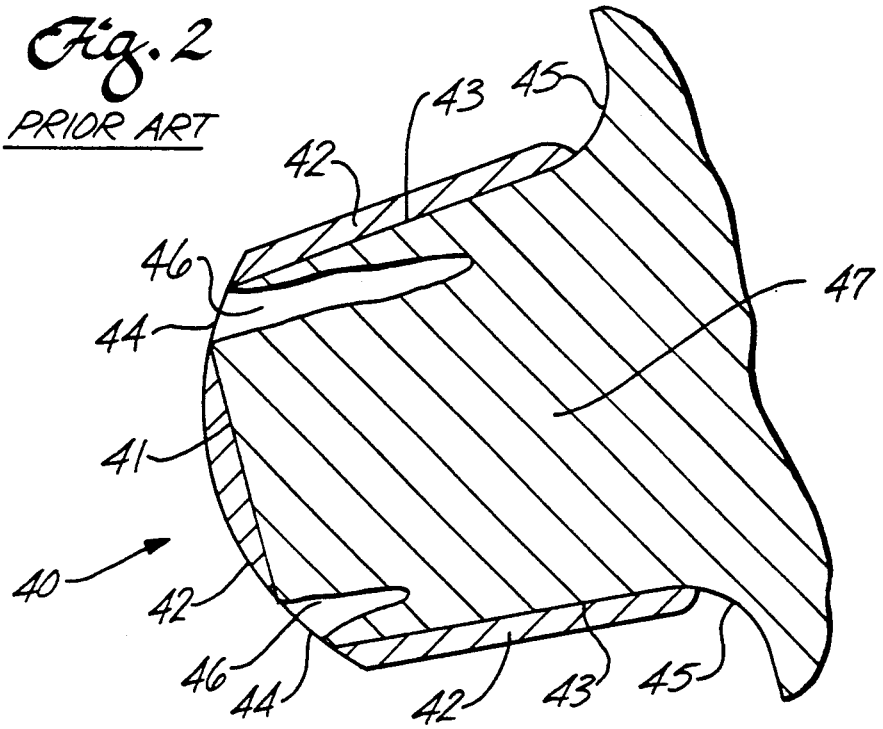
Fig. 2 PRIOR ART
FIG. 2 is a cross-sectional prior art view of a worn tooth illustrating destructive voids in the hardfacing and base metal material at the corners of the crest of the tooth.

Turning now to the prior art of FIG. 2, conventional hardfaced chisel crested teeth generally designated as 40, when they operate in a borehole for a period of time, wear on the corners 44 of the teeth. The prior art tooth consists of a crown or crest 41 having hardfacing material 42 across the crest and down the flanks 43 terminating near the base 45 of the tooth 40.

As heretofore stated the hardfacing material 42 transitioning from the crest 41 towards to the flanks 43 is very thin at the corners of the conventional teeth 40. Consequently, as the tooth wears, the hardfacing, since it is very thin, wears out quickly thus exposing the underlying steel 47 of the tooth 40. Consequently, erosion voids 46 easily invade the base metal 47 since it is much softer than hardfacing material 42.

Figure 3:
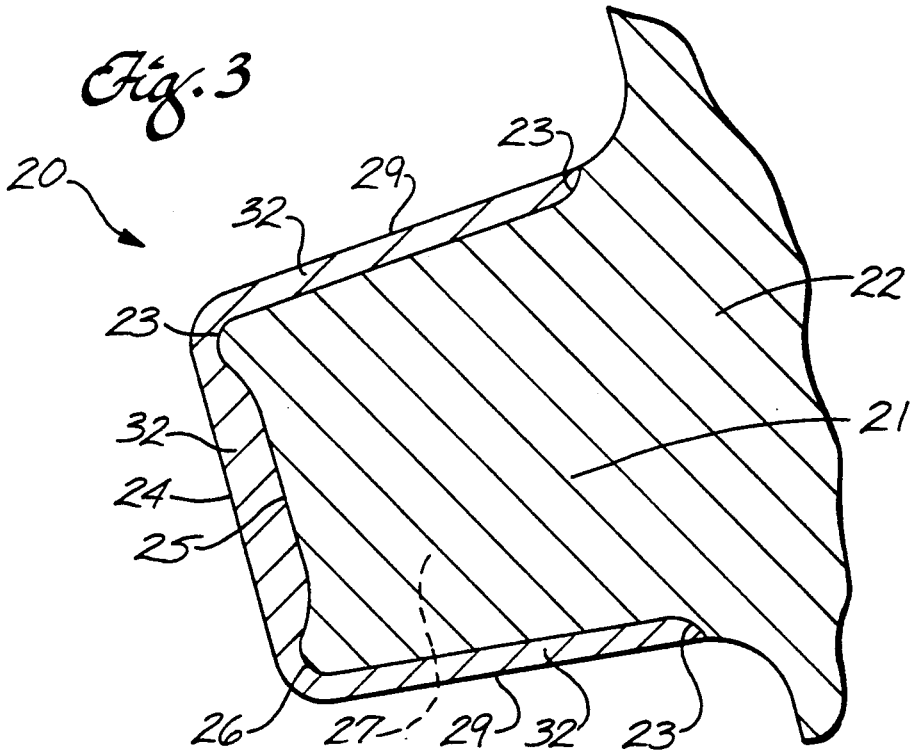
FIG. 3 is a cross-sectional view of an improved hardfaced chisel crested milled tooth.

Turning now to the preferred embodiment of FIG. 3, the chisel tooth generally designated as 20 consists of, for example, steel foundation 21, forming flanks 27, ends 29 and a crest 24. Between the rounded corners 26 is a concave portion 25 formed by the crest 24 of the tooth. The concave portion 25 enables the hardfacing material to form a thicker portion at the middle of the crest 24 therefore providing a more robust cutting crest 24. Each of the corners 26 have a sufficient radius so that the thickness of the hardfacing material is assured as it transitions from the crest 24 towards the ends 29 and the flanks 27 of the tooth 20. The hardfacing material terminates in a groove or shoulder 23 formed at the base 22 at each of the teeth 20. The shoulder or groove 23 provides a termination point for the hardfacing material 32 as it is applied over the crest ends and flanks of each of the teeth 20.

By providing a concave portion or depression 25 and rounded corners 26 at the end of the crested tooth, the hardfacing material may be applied more generously in the center of the crest and at a sufficient thickness around the rounded corners 26. The large radius at the corners assure a thick hardfacing material at a vulnerable area of the tooth.

A preferred hardfacing material is described in U.S. Pat. No. 4,836,307 assigned to the same assignee as the present invention and incorporated by reference herein.

Figure 4:
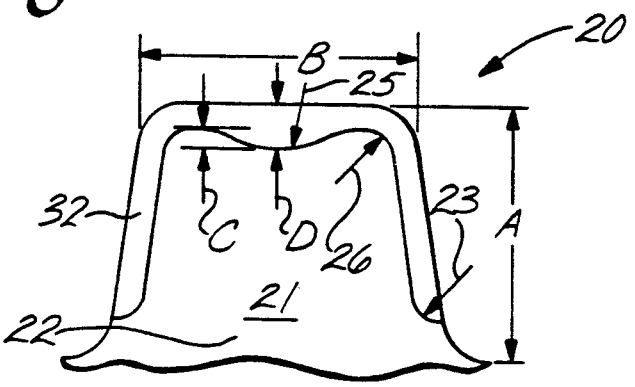
FIG. 4 is a diagrammatic cross-section of a tooth of a $7\frac{7}{8}''$ milled tooth rotary cone rock bit.

Referring now to the cross-sectional example of FIG. 4, a typical tooth 20 formed from a cone of a 7⅞ diameter milled tooth rotary cone rock bit would, for example, have a tooth height "A" 0.72 inches and a width "B" 0.62 inches across the chisel crown of the tooth. The radius 23 at the base groove may be between 0.06" and 0.13". The radius at the corners 26 may be between 0.02" and 0.20" with a preferred radius of 0.06". The concave radius 25 may be between 0.15" and 0.40" with a preferred radius of 0.35". The depth "C" of the concave radius may be between 0.00" and 0.06" with a preferred depth of 0.04".

Obviously, the crest 24 of the tooth 20 may be flat between radiused corners, the tooth having a constant hardfacing thickness between radiused corners.

The hardfacing 32 having a thickness along the ends 29, flanks 27 and corners 26 between 0.04" and 0.08" with a preferred thickness of 0.06".

The thickness of the hardfacing at depth "D" is between 0.08" and 0.12" with a preferred depth of 0.10" with respect to the example of FIG. 3.

Figure 5:
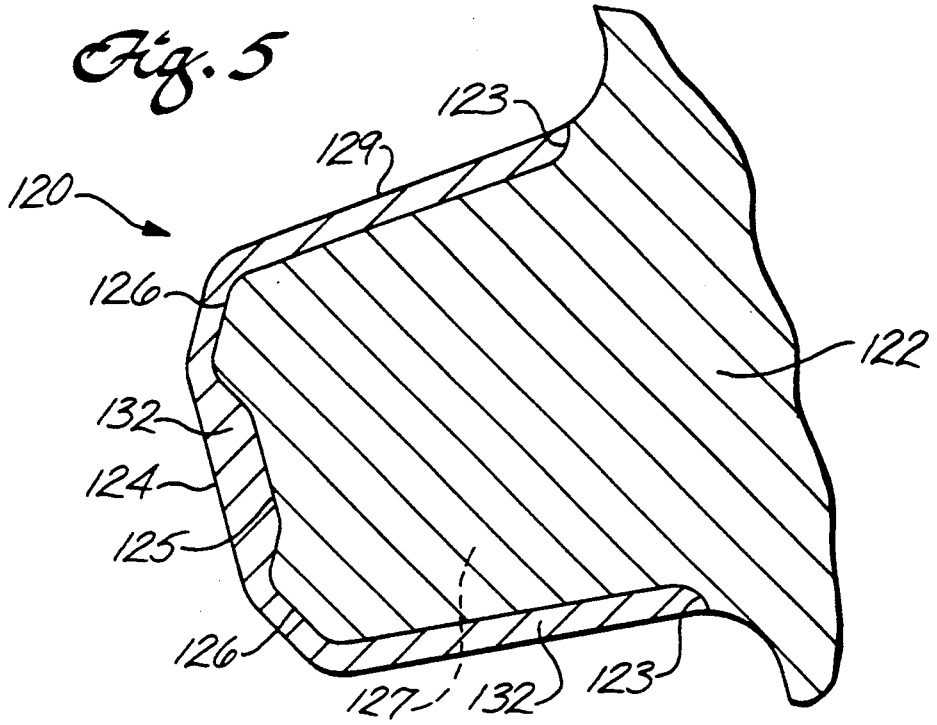
FIG. 5 is a cross-sectional view of another configuration of an improved hardfaced milled tooth.

FIG. 5 is an alternative embodiment of the present invention wherein the chisel crest tooth generally designated as 120 forms a crest 124 that transitions into ends 129 and flanks 127. Crest 124 forms a depression 125 between ends 126 that allows a thicker hardfacing material at the center of the crest. The hardfacing material maintains a relatively thick layer across the angled ends 126 and down the ends and flanks 129 and 127 towards the groove or shoulder 123. Again the object is to provide a robust or thick hardfacing material across the flanks 124 and ends 126 such that the tooth as it operates in a borehole retains its integrity and sharpness as it works in a borehole.

Figure 6:
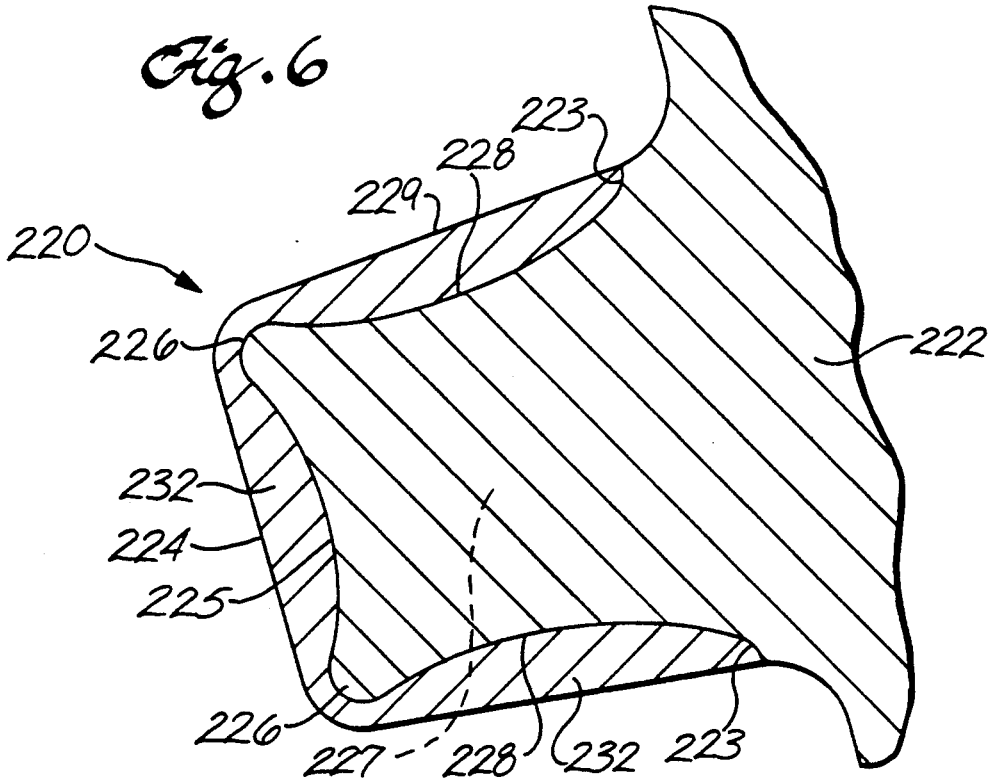
FIG. 6 is a cross-sectional view of yet another embodiment of the invention.

FIG. 6 is yet another alternative embodiment illustrating a tooth generally designated as 220, the chisel crested tooth having a crest 224, a depression at the center of the crest 225 and rounded ends 226 much as is shown in FIGS. 3 and 4. However, the ends 229 have a depression or concave portion 228 whereby the hardfacing material is thicker at the concave portion 228 thus providing a thicker area along the ends 229. It would be obvious to provide the same concave portion on each of the flanks 227. Again hardfacing terminates along shoulder 223 at base 222 at each of the mill teeth 220.

Figure 7:
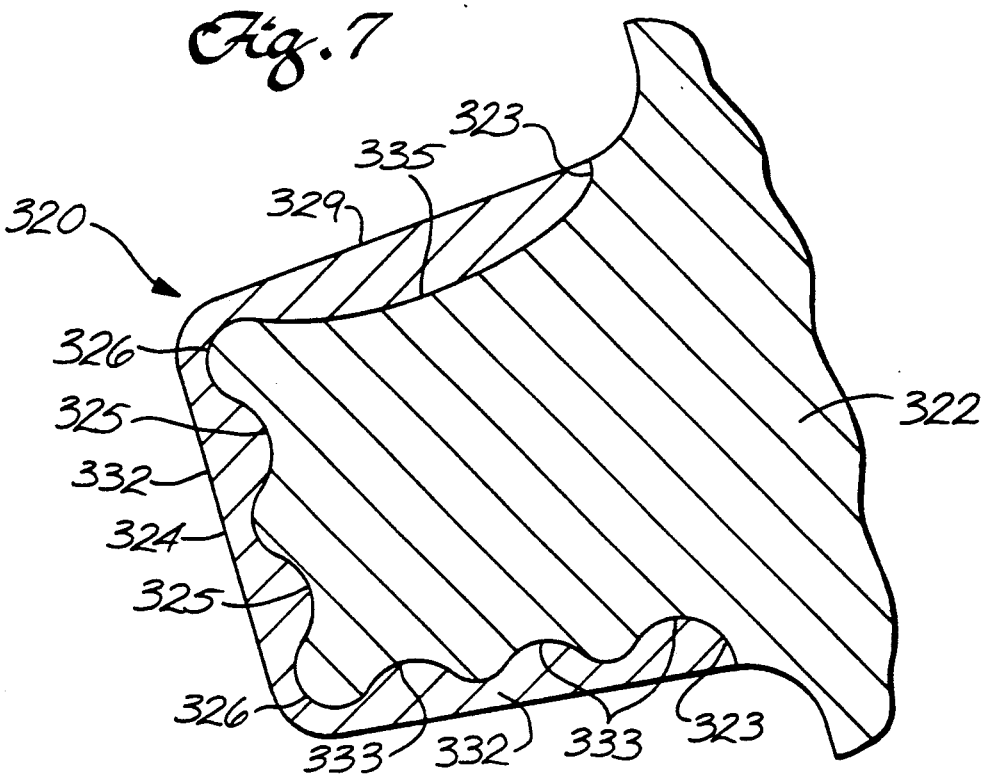
FIG. 7 is a cross-sectional view of still another embodiment of the invention.

FIG. 7 is still another alternative embodiment illustrating a chisel crested tooth generally designated as 320. The tooth 320 has a pair of concave portions 325 along the crest 324, the ends 326 being rounded in much the same manner as FIGS. 3, 4, 5 and 6 thus assuring a thickness at the corners of the tooth 320. The ends 329 may have a concave portion 335 or the flanks and end may have a series of depressions 333 to assure a robust layer of hardfacing 332 along the crest ends and flanks 324, 327 and 329 thereby assuring that the hardfacing material 332 is retained on the tooth 320. Again the hardfacing material terminates on a groove or shoulder or recess 323 at base 322 of the tooth 320.

Figure 8:
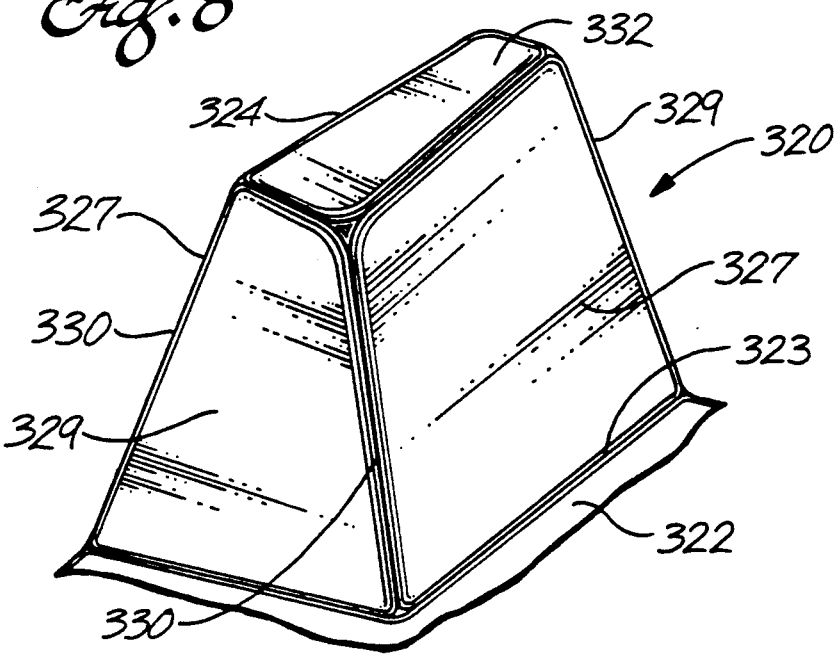
FIG. 8 is a perspective view of a single chisel crested milled tooth with hardfacing in a thicker layer around rounded corners of the tooth adjacent the flank and end faces of the tooth.

FIG. 8 illustrates a perspective view of one of the chisel crested teeth 320 wherein the corners 330 of the tooth is rounded, again for the purpose of assuring that a minimum thickness of hardfacing material is on the corner 330 which forms the junctions between the ends 329 and flanks 327 for the purpose of assuring a thickness over the entire tooth thereby improving the integrity and durability of the hardfacing material 332 on the tooth 320.

It would be obvious to hardface a milled tooth with a straight chisel crest converging at both radiused ends without departing from the scope of this invention as stated before. The thickness of the hardfacing would remain constant across the crest in keeping with the parameters of the specific example of FIG. 4.

Moreover, it would be obvious to hardface a spherical or semi-spherical surface of a milled tooth as long as the radiuses are equal to or greater than the parameters as set forth in FIG. 4 thereby assuring a minimum thickness of hardfacing and the enhanced durability of the tooth as it works in a borehole.

Each tooth, after the hardfacing is applied, will appear outwardly with relatively straight crest, ends and flanks, the hardfacing having a uniform termination point adjacent the shoulder 323 formed at the base 322 of the milled tooth 320.

It will of course be realized that various modifications can be made in the design and operation of the present invention without departing from the spirit thereof. Thus while the principle preferred construction and mode of operation of the invention have been explained in what is now considered to represent its best embodiments which have been illustrated and described it should be understood that within the scope of the appended claims the invention may be practiced otherwise than as specifically illustrated and described.

We claim:

1. A method of hardfacing milled teeth formed by a cutter cone of a milled tooth rotary cone rock bit comprising the step of:

shaping said milled teeth into at least one chisel crest having a transverse surface between one corner of said crest, radiusing each corner formed by said milled teeth at each end of said chisel crest, and applying hardfacing material over said at least one chisel shaped tooth, said hardfacing material is applied over said radiused corners such that a substantially uniform thickness of said hardfacing is maintained over said tooth and each of said corners formed by said chisel crest to prevent hardfacing failures at said corners during operation of said milled tooth rotary cone rock bit in a borehole.

2. A method of hardfacing milled teeth formed by, a cutter cone of a milled tooth rotary cone rock bit comprising the steps of:

shaping a crest of at least one chisel shaped mill tooth in one or more concave depressions from one corner to an opposite corner of said crest, radiusing each of said corners at the ends of the crest of said chisel shaped tooth, and applying hardfacing material over said at least one chisel shaped mill tooth, said hardfacing material is applied over said radiused corners and is thicker in said concave crest areas between said radiused corners to prevent hardfacing failures at said corners and along said crest during operation of said milled tooth rotary cone rock bit in a borehole.

3. The method as set forth in claim 2 further comprising the step of:

forming a hardface limiting shoulder substantially around a base of each of said at least one chisel shaped mill tooth, said shoulder serves to provide a uniform termination point for a layer of hardfacing material from said shoulder across flanks and ends formed by said tooth around said radiused corner and across said concave crest of said chisel cutter.

4. The method as set forth in claim 2 wherein there is a single concave depression formed between radiused ends of said crest of said milled teeth.

5. The method as set forth in claim 2 further comprising the step of forming multiple concave depressions between radiused ends of said chisel crested milled teeth.

6. The method as set forth in claim 2 further comprising the step of radiusing the corners formed by said chisel crested milled teeth adjacent the ends and flanks of said teeth transitioning toward the crest of each of said milled teeth.

7. The method as set forth in claim 6 further comprising the step of forming one or more concave depressions formed by said milled teeth in said ends and flanks of said teeth between said crest and a hardface limiting shoulder formed around a base of said teeth.

8. The method as set forth in claim 7 wherein a single concave depression is formed in each end of said milled teeth between said crest and said shoulder formed by said teeth at said base of said teeth.

9. The method as set forth in claim 7 wherein a single concave depression is formed in each flank of said milled teeth between said crest and said shoulder formed at said base of said teeth.

10. The method as set forth in claim 7 further comprising the step of applying hardfacing material over said chisel shaped teeth at a sufficient thickness to cover said tooth around said radiused corners and across said concave, flanks, ends and crest, an outward appearance of said hardfaced teeth after said hardfacing application having relatively flat surfaces at the ends, flanks and crest of said teeth.

11. A method of hardfacing milled teeth formed by a cutter cone of a milled tooth rotary cone rock bit comprising the steps of:

shaping a crest of a chisel shaped mill tooth in a concave depression from one corner to an opposite corner of said crest, radiusing each of said corners at the ends of the crest of said chisel shaped tooth, forming a hardface limiting shoulder substantially around a base of each of said teeth, said shoulder serves to provide a uniform termination point for a hardfacing material, radiusing each corner formed by said chisel crested tooth adjacent the ends and flanks of said tooth between said shoulder and said crest of said tooth, and applying hardfacing material over said chisel shaped mill tooth, said hardfacing material is applied over said radiused corners adjacent said end and flanks of said tooth and at the ends of said crest and is thicker in said concave crest area between said radiused corners to prevent hardfacing failures at said corners and along said crest during operation of said milled tooth rotary cone rock bit in a borehole.

12. A method as set forth in claim 11 wherein said hardfacing material thickness at said radiused corners formed by said chisel crested tooth adjacent each corner of said crest, and adjacent the ends and flanks formed by said tooth is at least as thick as the radial dimension of said corners, said hardfacing material over said ends and flanks of said tooth is about the same thickness as said corners.

13. A method as set forth in claim 12 wherein said hardfacing material in said concave depression is up to twice as thick at the center of said depression formed by said crest of said tooth as said thickness of said hardfacing around said corners cnds and flanks of said tooth.

14. A method as set forth in claim 11 wherein said cone is formed from steel.

15. A method as set forth in claim 11 wherein said hardfacing is formed from a tungsten carbide matrix.

* * * * *